US010315438B2

(12) United States Patent
Hunsberger, Jr.

(10) Patent No.: US 10,315,438 B2
(45) Date of Patent: Jun. 11, 2019

(54) THERMAL PRINT HEAD USAGE MONITOR AND METHOD FOR USING THE MONITOR

(71) Applicant: Zebra Technologies Corporation, Lincolnshire, IL (US)

(72) Inventor: Alvin Hunsberger, Jr., New Britain, PA (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

(21) Appl. No.: 15/044,289

(22) Filed: Feb. 16, 2016

(65) Prior Publication Data

US 2016/0159104 A1 Jun. 9, 2016

Related U.S. Application Data

(63) Continuation of application No. 10/997,516, filed on Nov. 24, 2004, now Pat. No. 9,296,214.

(60) Provisional application No. 60/608,947, filed on Jul. 2, 2004.

(51) Int. Cl.

| | |
|---|---|
| ***B41J 29/38*** | (2006.01) |
| ***B41J 2/355*** | (2006.01) |
| ***B41J 2/175*** | (2006.01) |

(52) U.S. Cl.

CPC ..... *B41J 2/355* (2013.01); *B41J 2/17546* (2013.01)

(58) Field of Classification Search

USPC ..... 347/9, 43, 171; 717/170

See application file for complete search history.

(56) References Cited

U.S. PATENT DOCUMENTS

| | | | |
|---|---|---|---|
| 4,496,237 | A | 1/1985 | Schron |
| 4,513,298 | A | 4/1985 | Scheu |
| 4,551,000 | A | 11/1985 | Kanemitsu |
| 4,585,327 | A | 4/1986 | Suzuki |
| 4,634,258 | A | 1/1987 | Tanaka |
| 4,751,484 | A | 6/1988 | Matwsumoto |
| 4,851,875 | A | 7/1989 | Tanimoto |
| 4,855,754 | A | 8/1989 | Tanaka |
| 4,870,459 | A | 9/1989 | Osaka |
| 4,882,604 | A | 11/1989 | Kato |
| 4,930,915 | A | 6/1990 | Kikuchi |
| 4,961,088 | A | 10/1990 | Gilliland |
| 4,970,531 | A | 11/1990 | Shimizu |
| 4,970,533 | A | 11/1990 | Saito et al. |
| 4,974,020 | A | 11/1990 | Takamatsu |
| 4,994,853 | A | 2/1991 | Fukuchi |

(Continued)

FOREIGN PATENT DOCUMENTS

| | | |
|---|---|---|
| DE | 19954749 | 5/2001 |
| EP | 0551752 A2 | 12/1992 |

(Continued)

OTHER PUBLICATIONS

Extended European Search Report for European Patent Application No. 10011174.9, dated Dec. 2, 2010.

(Continued)

*Primary Examiner* — Lam S Nguyen

(57) ABSTRACT

An example disclosed print head includes memory to store data associated with the print head; and a controller to encrypt a communication including the data stored in the memory, wherein the communication is to be transmitted from the print head to a device.

18 Claims, 3 Drawing Sheets

(56) References Cited

U.S. PATENT DOCUMENTS

| | | | |
|---|---|---|---|
| 5,049,898 | A | 9/1991 | Arthur |
| 5,049,904 | A | 9/1991 | Nakamura |
| 5,066,978 | A | 11/1991 | Watarai |
| 5,078,523 | A | 1/1992 | Gourty |
| 5,115,275 | A | 5/1992 | Suzuki |
| 5,132,729 | A | 7/1992 | Matsushita |
| 5,137,379 | A | 8/1992 | Ukai |
| 5,148,534 | A | 9/1992 | Comerford |
| 5,206,685 | A | 4/1993 | Hara |
| 5,216,464 | A | 6/1993 | Kotani |
| 5,266,968 | A | 11/1993 | Stephenson |
| 5,272,503 | A | 12/1993 | Lesueur |
| 5,276,461 | A | 1/1994 | Saito |
| 5,283,597 | A | 2/1994 | Yoshida |
| 5,283,613 | A | 2/1994 | Midgley |
| 5,300,954 | A | 4/1994 | Murano et al. |
| 5,304,007 | A | 4/1994 | Flanagan |
| 5,315,320 | A | 5/1994 | Murano |
| 5,319,426 | A | 6/1994 | Baruch |
| 5,318,370 | A | 7/1994 | Nehowig |
| 5,333,960 | A | 8/1994 | Nam |
| 5,363,134 | A | 11/1994 | Barbehenn |
| 5,371,525 | A | 12/1994 | Murano |
| 5,385,416 | A | 1/1995 | Maekawa |
| 5,410,641 | A | 4/1995 | Wakabayashi |
| 5,414,452 | A | 5/1995 | Accatino et al. |
| 5,452,059 | A | 9/1995 | Sekiya |
| 5,455,617 | A | 10/1995 | Stephenson |
| 5,479,467 | A | 12/1995 | Katsumata |
| 5,486,057 | A | 1/1996 | Skinner et al. |
| 5,489,971 | A | 2/1996 | Nam |
| 5,491,540 | A | 2/1996 | Hirst |
| 5,510,884 | A | 4/1996 | Bov |
| 5,512,988 | A | 4/1996 | Donaldson |
| 5,528,277 | A | 6/1996 | Nardone et al. |
| 5,546,163 | A | 8/1996 | Asai |
| 5,548,374 | A | 8/1996 | Iguchi |
| 5,570,123 | A | 10/1996 | Almonte |
| 5,572,292 | A | 11/1996 | Chatani |
| 5,579,088 | A | 11/1996 | Ko |
| 5,585,825 | A | 12/1996 | Kneezel et al. |
| 5,589,868 | A | 12/1996 | Schofield et al. |
| 5,610,635 | A | 3/1997 | Murray |
| 5,627,572 | A | 5/1997 | Harrington |
| 5,636,032 | A | 6/1997 | Springett |
| 5,646,660 | A | 7/1997 | Murray |
| 5,657,066 | A | 8/1997 | Adams et al. |
| 5,666,585 | A | 9/1997 | Nagira |
| 5,671,002 | A | 9/1997 | Murano |
| 5,699,091 | A | 12/1997 | Bullock |
| 5,699,100 | A | 12/1997 | Fukuda |
| 5,706,037 | A | 1/1998 | McIntyre |
| 5,708,912 | A | 1/1998 | Lee |
| RE35,751 | E | 3/1998 | Midgley |
| 5,755,519 | A | 5/1998 | Klinmefeiter |
| 5,760,795 | A | 6/1998 | Beck |
| 5,768,991 | A | 6/1998 | Cless et al. |
| 5,786,828 | A | 7/1998 | Yamamoto |
| 5,787,278 | A | 7/1998 | Barton |
| 5,788,388 | A | 8/1998 | Cowger |
| 5,794,095 | A | 8/1998 | Thompson |
| 5,797,060 | A | 8/1998 | Thompson |
| 5,807,005 | A | 9/1998 | Wright |
| 5,812,156 | A | 9/1998 | Bullock et al. |
| 5,812,902 | A | 9/1998 | Lee |
| 5,816,718 | A | 10/1998 | Poole |
| 5,823,690 | A | 10/1998 | Narushima |
| 5,831,649 | A | 11/1998 | Wastrobski |
| 5,835,817 | A | 11/1998 | Bullock |
| 5,835,818 | A | 11/1998 | Hoshika |
| 5,838,358 | A | 11/1998 | Suzuki |
| 5,717,974 | A | 12/1998 | Park |
| 5,847,814 | A | 12/1998 | Antziopoulos |
| 5,848,848 | A | 12/1998 | St. Jean |
| 5,860,363 | A | 1/1999 | Childers |
| 5,874,980 | A | 2/1999 | West |
| 5,877,692 | A | 3/1999 | Watanabe |
| 5,878,298 | A | 3/1999 | Nakano |
| 5,907,739 | A | 3/1999 | Tsunemi |
| 5,907,748 | A | 5/1999 | Kawana |
| 5,909,233 | A | 6/1999 | Hamman et al. |
| 5,926,192 | A | 7/1999 | Yamana |
| 5,926,665 | A | 7/1999 | Suzuki |
| 5,926,666 | A | 7/1999 | Miura |
| 5,930,553 | A | 7/1999 | Hirst |
| 5,937,225 | A | 8/1999 | Samuels |
| 5,940,095 | A | 8/1999 | Parish |
| 5,950,038 | A | 9/1999 | Okui |
| 5,963,759 | A | 10/1999 | Kojima |
| 5,966,144 | A | 10/1999 | Edwards |
| 5,978,004 | A | 11/1999 | Ehrhardt |
| 5,979,061 | A | 11/1999 | Demlakian-Apkarian |
| 5,995,774 | A | 11/1999 | Applegate |
| 6,000,773 | A | 12/1999 | Murray |
| 6,011,937 | A | 1/2000 | Chaussade |
| 6,014,533 | A | 1/2000 | Kawana |
| 6,016,409 | A | 1/2000 | Beard |
| 6,019,449 | A | 2/2000 | Bullock |
| 6,019,461 | A | 2/2000 | Yoshimura |
| 6,022,094 | A | 2/2000 | Gibson |
| 6,028,674 | A | 2/2000 | Tognazzini |
| 6,039,430 | A | 3/2000 | Helterline |
| 6,057,870 | A | 5/2000 | Monnier et al. |
| 6,065,824 | A | 5/2000 | Bullock |
| 6,068,372 | A | 5/2000 | Rousseau |
| 6,068,415 | A | 5/2000 | Smolenski |
| 6,070,805 | A | 6/2000 | Kaufman et al. |
| 6,089,687 | A | 7/2000 | Helterline |
| 6,097,906 | A | 8/2000 | Matsuzaki |
| 6,099,101 | A | 8/2000 | Maurelli |
| 6,099,178 | A | 8/2000 | Spurr |
| 6,106,088 | A | 8/2000 | Wafler |
| 6,106,166 | A | 8/2000 | Spurr |
| 6,112,036 | A | 8/2000 | Shinohara |
| 6,113,208 | A | 9/2000 | Benjamin |
| 6,126,265 | A | 10/2000 | Childers |
| 6,144,812 | A | 11/2000 | Ueno |
| 6,147,767 | A | 11/2000 | Petteruti et al. |
| 6,151,037 | A | 11/2000 | Kaufman et al. |
| 6,151,041 | A | 11/2000 | Bolash |
| 6,158,837 | A | 12/2000 | Hilton |
| 6,158,850 | A | 12/2000 | Cook |
| 6,161,913 | A | 12/2000 | Childers |
| 6,161,916 | A | 12/2000 | Gibson |
| 6,163,658 | A | 12/2000 | Suzuki |
| 6,173,128 | B1 | 1/2001 | Saber |
| 6,181,885 | B1 | 1/2001 | Best |
| 6,188,423 | B1 | 2/2001 | Pou |
| 6,188,852 | B1 | 2/2001 | Ojima |
| 6,195,115 | B1 | 2/2001 | Yamaguchi |
| 6,196,670 | B1 | 3/2001 | Saruta |
| 6,196,736 | B1 | 3/2001 | Otsuki |
| 6,227,643 | B1 | 5/2001 | Purcell |
| 6,233,409 | B1 | 5/2001 | Haines |
| 6,243,120 | B1 | 6/2001 | Hevenor |
| 6,263,170 | B1 | 7/2001 | Bortnem |
| 6,264,301 | B1 | 7/2001 | Helterline |
| 6,266,492 | B1 | 7/2001 | Maehara |
| 6,267,463 | B1 | 7/2001 | Paulsen |
| 6,271,928 | B1 | 8/2001 | Bullock |
| 6,286,923 | B1 | 9/2001 | Sugajara |
| 6,295,423 | B1 | 9/2001 | Haines |
| 6,302,527 | B1 | 10/2001 | Walker |
| 6,305,795 | B2 | 10/2001 | Childers |
| 6,312,072 | B1 | 11/2001 | Hough |
| 6,312,083 | B1 | 11/2001 | Moore |
| 6,312,106 | B1 | 11/2001 | Walker |
| 6,325,495 | B1 | 12/2001 | Foth |
| 6,332,062 | B1 | 12/2001 | Phillips |
| 6,339,684 | B1 | 1/2002 | Sato |
| 6,343,193 | B1 | 1/2002 | Matsumoto |
| 6,349,182 | B2 | 2/2002 | Otsubo |
| 6,351,618 | B1 | 2/2002 | Pollocks |
| 6,351,621 | B1 | 2/2002 | Richards |

(56) References Cited

U.S. PATENT DOCUMENTS 6,363,226 B1 3/2002 Batori
6,366,742 B1 4/2002 Reihi
6,375,301 B1 4/2002 Childers
6,381,418 B1 4/2002 Spurr
6,381,419 B1 4/2002 Kinoshita
6,385,407 B1 5/2002 Inose
6,386,772 B1 5/2002 Klinefelter
6,406,120 B2 * 6/2002 Pauschinger .... G07B 17/00314 347/19
6,408,141 B1 6/2002 Tahara
6,409,298 B1 6/2002 Ahne et al.
6,409,401 B1 6/2002 Petteruti et al.
6,418,283 B1 7/2002 Wegman
6,427,054 B1 7/2002 Ohkubo
6,431,703 B2 8/2002 Rousseau
6,438,329 B1 8/2002 Budnik
6,454,381 B1 9/2002 Olsen
6,459,860 B1 10/2002 Childers
6,464,322 B2 10/2002 Dunand
6,467,864 B1 10/2002 Cornell
6,467,888 B2 10/2002 Wheeler
6,473,571 B1 10/2002 Wegman
6,478,399 B1 11/2002 Mitsuzawa
6,481,907 B2 11/2002 Banach et al.
6,488,352 B1 12/2002 Helterline
6,490,420 B2 12/2002 Pollocks
6,493,519 B2 12/2002 Sasame
6,498,905 B1 12/2002 Tsuruya
6,502,240 B1 * 12/2002 Naclerio ..... G06F 8/65 705/401
6,502,917 B1 1/2003 Shinada
6,505,013 B1 1/2003 Bedford
6,505,926 B1 1/2003 Trafton
6,511,142 B1 1/2003 Carmon
6,512,894 B2 1/2003 Takemoto
6,522,348 B1 2/2003 Brot
6,523,926 B1 2/2003 Mitsuzawa et al.
6,527,356 B1 3/2003 Spurr
6,532,351 B2 3/2003 Richards
6,535,697 B2 3/2003 Reihi
6,539,867 B2 4/2003 Lee
6,546,211 B1 4/2003 Shishikura
6,546,212 B1 4/2003 Ogata
6,550,902 B2 4/2003 Shinada
6,556,792 B2 5/2003 Yoshimura
6,559,973 B2 5/2003 Bullock
6,565,176 B2 5/2003 Anderson
6,565,198 B2 5/2003 Saruta
6,583,803 B2 6/2003 Poole et al.
6,584,290 B2 6/2003 Kurz
6,584,291 B1 6/2003 Yamamoto
6,587,649 B1 7/2003 Yamamoto
6,588,872 B2 7/2003 Anderson
6,593,952 B1 7/2003 Funayama
6,597,875 B2 7/2003 Hasegawa
6,597,876 B1 7/2003 Sakurai
6,603,497 B2 8/2003 Hevenor
6,608,975 B2 8/2003 Sakurai
6,621,989 B2 9/2003 Otomo
6,625,402 B2 9/2003 Takemoto
6,629,134 B2 9/2003 Hayward
6,634,738 B1 10/2003 Shinada
6,636,702 B2 10/2003 Abe
6,644,544 B1 11/2003 Spurr
6,644,771 B1 11/2003 Silverbrook
6,683,638 B2 1/2004 Sato
6,687,634 B2 2/2004 Borg
6,694,107 B2 2/2004 Sakurai
RE38,473 E 3/2004 Smolenski
6,708,005 B2 3/2004 Chihara
6,714,745 B2 3/2004 Sasame
6,722,753 B2 4/2004 Heltelrlne
6,735,399 B2 5/2004 Tabb
6,738,903 B1 5/2004 Haines
6,748,182 B2 6/2004 Yoshida
6,791,704 B1 9/2004 Moreau
6,793,307 B2 9/2004 Spurr
6,798,997 B1 9/2004 Hayward
6,799,001 B2 9/2004 Takeuchi
6,802,659 B2 10/2004 Cremon
6,807,380 B2 10/2004 Lida
6,807,382 B1 10/2004 Sakurai
6,820,039 B2 11/2004 Johnson
6,853,814 B2 2/2005 Ito
6,871,027 B2 3/2005 Ito
6,879,785 B2 4/2005 Ito
6,879,786 B2 4/2005 Ito
6,894,711 B2 5/2005 Yamakawa
6,903,837 B1 6/2005 Moreau
6,904,242 B2 6/2005 Ito
6,963,351 B2 11/2005 Squires
7,025,268 B2 4/2006 Alleshouse
7,106,198 B2 9/2006 Phipps et al.
7,245,312 B2 7/2007 Smolenski et al.
7,372,475 B2 5/2008 Vazac et al.
7,398,054 B2 7/2008 Tsirline et al.
7,407,102 B2 8/2008 Alleshouse
7,498,942 B2 3/2009 Torchalski et al.
7,500,797 B2 3/2009 Boisdon et al.
2001/0048459 A1 12/2001 Sakai et al.
2002/0060708 A1 5/2002 Elliott
2002/0063760 A1 5/2002 Dietl
2002/0140751 A1 10/2002 Imanaka et al.
2002/0163662 A1 11/2002 Kaufman et al.
2003/0081021 A1 * 5/2003 Zaremba ..... B41J 2/17546 347/5
2004/0051751 A1 3/2004 Sekiya
2004/0080551 A1 4/2004 Nunokawa
2004/0080775 A1 4/2004 Owen et al.
2004/0125160 A1 * 7/2004 Anderson ..... B41J 2/17566 347/14
2004/0141019 A1 7/2004 Schloeman et al.
2005/0084315 A1 4/2005 Lodwig et al.
2005/0116975 A1 6/2005 Kasai
2005/0210610 A1 9/2005 Louie et al.
2006/0002753 A1 1/2006 Hunsberger et al.
2006/0020803 A1 1/2006 O'Hagan
2006/0164447 A1 7/2006 Poole et al.
2006/0171755 A1 8/2006 Clarke
2006/0221167 A1 10/2006 Maynard et al.
2006/0251461 A1 11/2006 Lodwig et al.
2007/0023068 A1 2/2007 Helma
2007/0031617 A1 2/2007 Field
2007/0081842 A1 4/2007 Ehrhardt, Jr.
2007/0099462 A1 5/2007 Helma et al.
2007/0147938 A1 6/2007 Brown et al.
2007/0212142 A1 9/2007 Zevin et al.
2008/0030771 A1 2/2008 Alleshouse
2008/0211840 A1 9/2008 Zevin et al.

FOREIGN PATENT DOCUMENTS

EP 0551752 A3 12/1992
EP 0766195 4/1997
EP 0802059 10/1997
EP 0935211 8/1999
EP 1182039 2/2002
EP 1300250 4/2003
JP 50116227 9/1975
JP 09065148 3/1997
WO 2003021390 3/2003

OTHER PUBLICATIONS

International Search Report for International Application No. PCT/US2006/039013, dated Feb. 27, 2007.
International Preliminary Report on Patentability for apoplication No. PCT/US2005/009771, dated Jan. 9, 2007.
International Search Report for application No. PCT/US2005/009771, dated Aug. 10, 2005.
Office Action for Chinese Application No. 200580029037.6, dated Aug. 31, 2008.

(56) References Cited

OTHER PUBLICATIONS

Office Action for Chinese Application No. 200580029037.6, dated Sep. 4, 2009.
Office Action for Chinese Application No. 200580029037.6, dated May 27, 2011.

* cited by examiner

THERMAL PRINT HEAD USAGE MONITOR AND METHOD FOR USING THE MONITOR

CROSS REFERENCE TO RELATED APPLICATION

This application is a continuation of U.S. patent application Ser. No. 10/997,516, filed Nov. 24, 2004, now U.S. Pat. No. 9,296,214, which claims the benefit of U.S. Provisional Patent Application Ser. No. 60/608,947, filed Jul. 2, 2004, which are both hereby incorporated herein by reference in their entireties.

BACKGROUND

The present invention is generally directed to a print head monitor and, more specifically, to a thermal printing system and method for monitoring thermal print head usage.

While many different types of thermal print heads are commonly used in business and residential printers, known print heads share common drawbacks. For example, when an allegedly defective thermal print head is returned to a manufacturer or distributor, it is usually difficult to determine whether the thermal print head is actually defective or whether the print head has been misused. Thermal print heads are designed for specific operating conditions and, depending upon the printer in which they are installed, may malfunction due to use outside of design parameters. Additionally, it can be difficult to determine how much actual use a consumer obtained from the print head prior to malfunction.

It would be advantageous to have a monitor or printing system that monitors thermal print head usage; that preferably stores print head operational and performance specifications; that preferably stores actual print head operating characteristics; that preferably provides data that can be used to optimize print head design parameters; and that preferably interfaces with remote operating systems.

SUMMARY

A thermal print head data acquisition unit that monitors print head functions and accumulates corresponding data which may be stored in a memory. A printing system with the data acquisition unit connected to the print head driver circuit will provide data that is useful in the analysis of print head use conditions and failure causes. The data acquisition unit may be assembled on board the print head or connected through an external connection, such as a USB, so that the data is transmitted to another part of the printing system or to an remote computer or memory.

BRIEF DESCRIPTION OF THE DRAWING(S)

The foregoing summary, as well as the following detailed description of the preferred embodiment of the present invention, will be better understood when read in conjunction with the appended drawings. For the purpose of illustrating the invention, there is shown in the drawings an embodiment which is presently preferred. It is understood, however, that the present invention is not limited to the precise arrangement and instrumentality shown. In the drawings.

DETAILED DESCRIPTION OF THE PREFERRED EMBODIMENT(S)

Certain terminology is used in the following description for convenience only and is not limiting. The term "linear print" means "linear print by a print head based on the printing having a specific resolution." The words "a" and "one", as used in the claims and in the corresponding portions of the specification, are defined as including one or more of the referenced item unless specifically stated otherwise.

Figure 1:
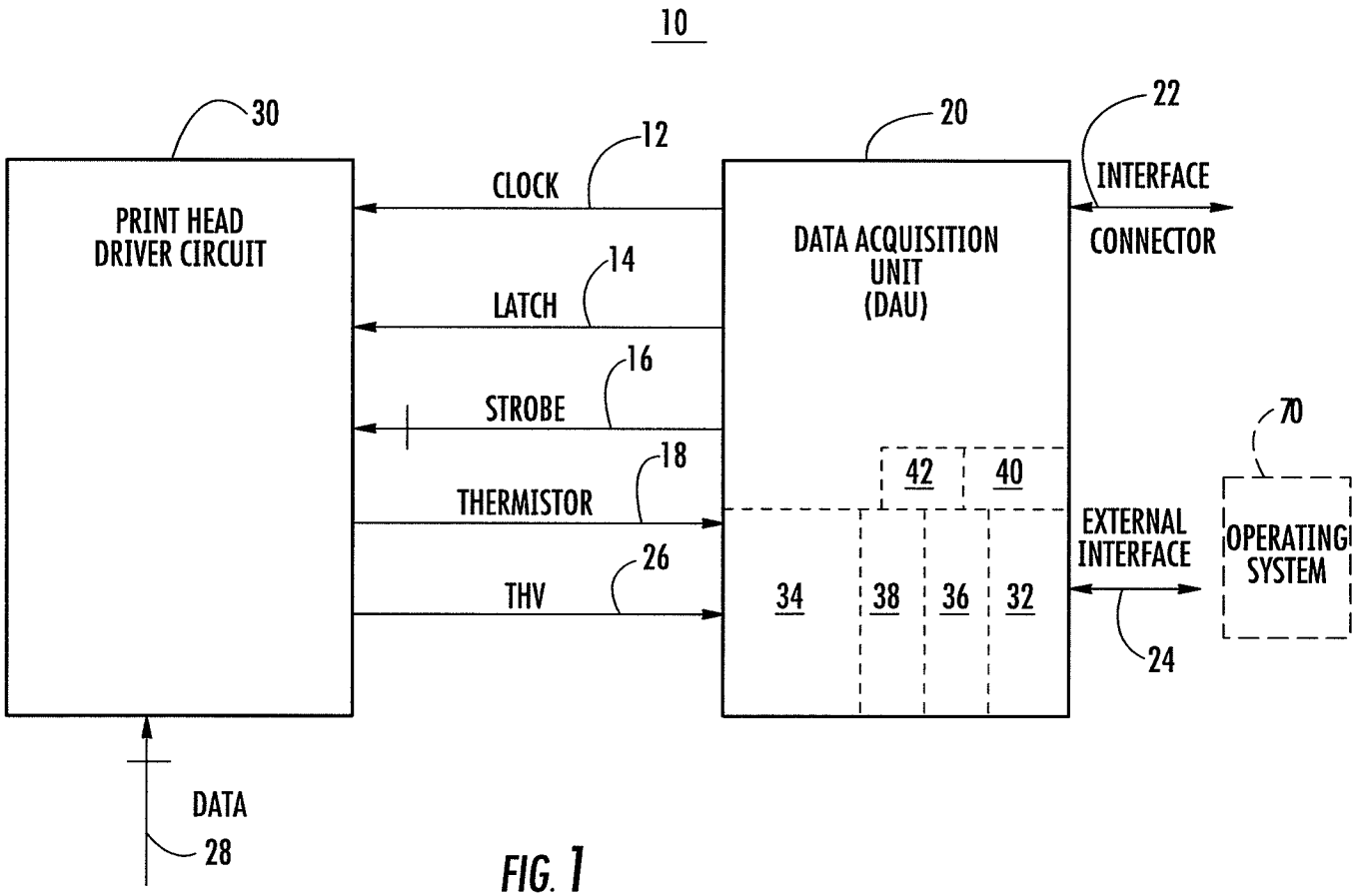
FIG. 1 is a block diagram of an exemplary embodiment of a printing system incorporating the present invention.
Figure 2:
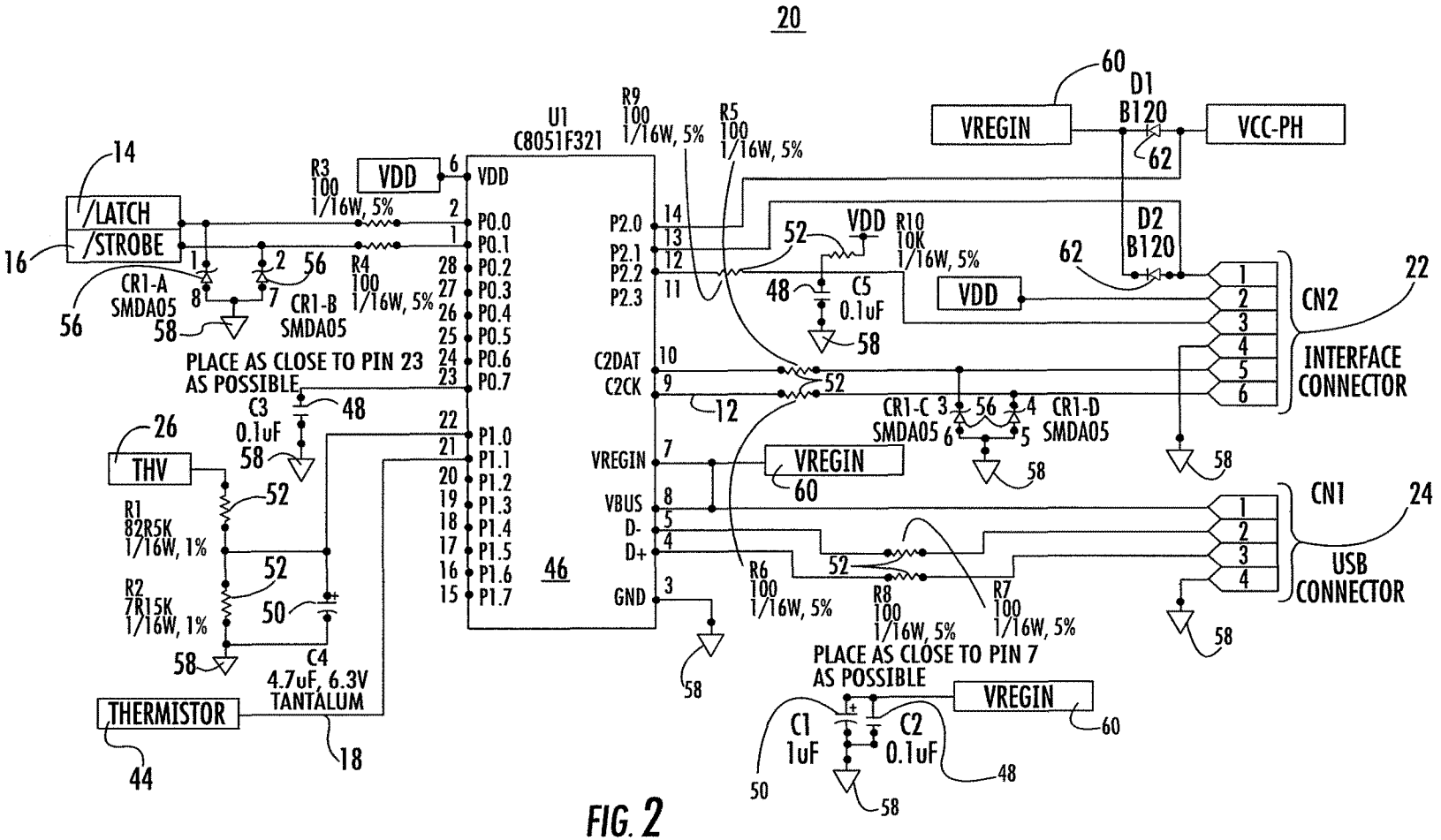
FIG. 2 is a schematic diagram of a preferred embodiment of a DAU of the printing system of FIG. 1.
Figure 3:
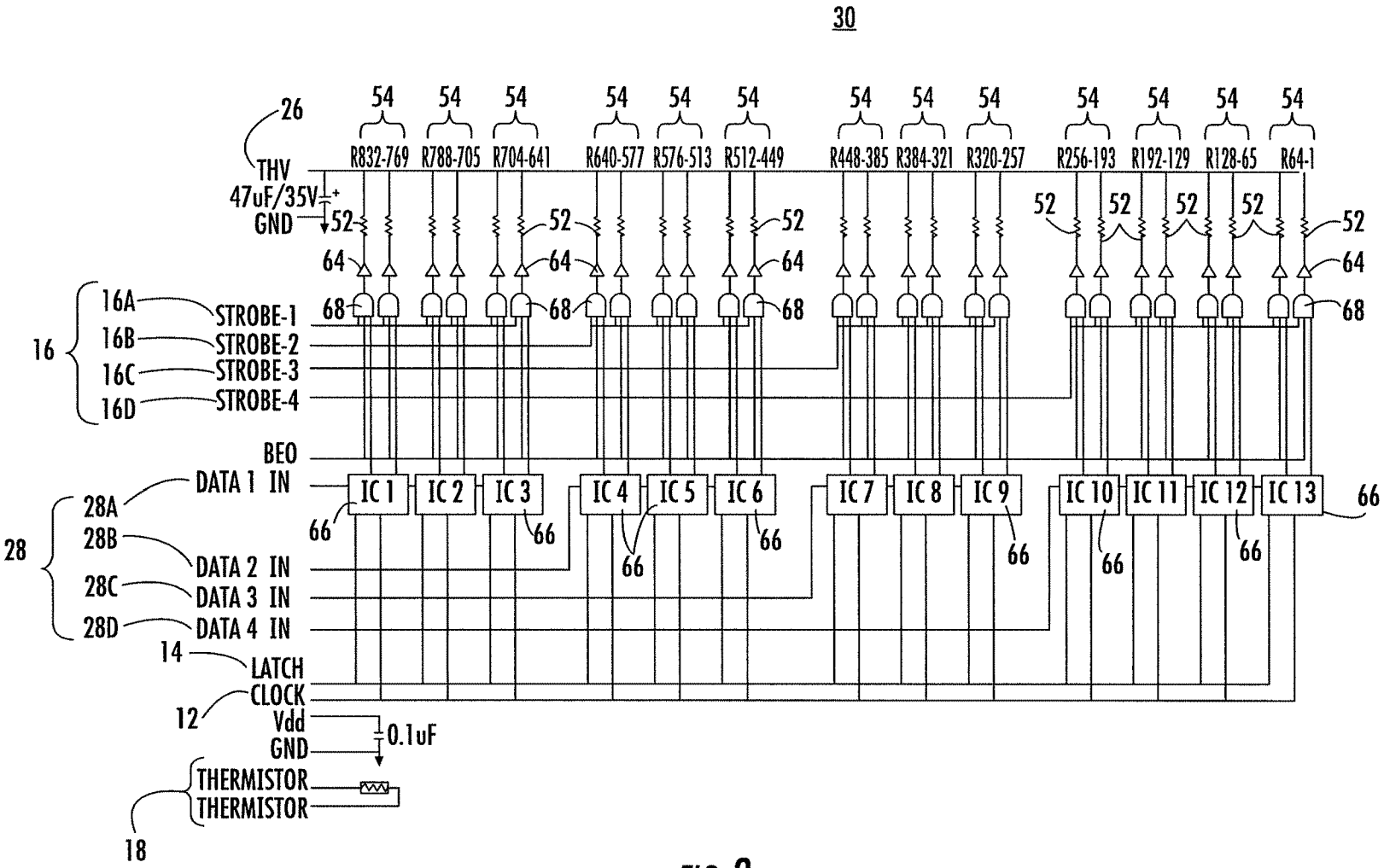
FIG. 3 is a schematic diagram of an exemplary print head driver circuit of a printing system of the type illustrated in FIG. 1.

Referring to FIGS. 1-3, wherein like numerals indicate like elements throughout, an exemplary embodiment of a printing system including a usage monitor of the present invention is shown and generally designated 10. Briefly stated, printing system 10 uses a data acquisition unit ("DAU") 20 to continually monitor actual usage of a print head. It is preferred that the DAU 20 periodically sweep across all print head functions to acquire periodic data regarding the operating environment of the print head and the status of the print head.

The printing system 10 shown in FIG. 1 preferably includes the thermal print head and the DAU 20. However, the DAU 20 can be separate from the print head without departing from the present invention. When the DAU 20 is provided in a stand alone package, it is separate from the print head board, but is equipped with a connector to be in communication with a pre-existing print head or printing systems. Through monitoring, errors in operation or in the printer environment that may lead to premature failure can be detected early, and preferably transmitted to a monitoring station. For example, if a thermal print head is designed to be used with a specific voltage range and it is used with a different range, the DAU 20 will communicate the problem prior to print head failure and permit corrective action.

In the preferred implementation, the DAU 20 allows for: storing of predetermined data prior to initial use by an end user; comparing and analyzing print head data during use; storing and transferring of print head data; and, when connected externally, processing requests for stored data.

Referring to FIG. 3, an exemplary print head driver circuit 30 for use with a thermal print head according to the exemplary configuration of FIG. 1. Other print head driver circuits can be used with the printing system 10 of the present invention and the specific circuit will depend upon the type of print head used. The DAU 20 of FIG. 1 is in communication with the print head driver circuit 30 through the communication connection 28.

The structure of an exemplary DAU 20 is shown in FIG. 2. The DAU 20 preferably includes a microcontroller 46. The microcontroller 46 preferably monitors and detects a clock signal 12, a latch signal 14, and a strobe signal 16 to the print head driver circuit 30. The microcontroller 46 preferably receives a thermistor signal 18 and a thermal head voltage (hereinafter referred to as "THV") signal 26 from the print head driver circuit 30. A standard five volt (5 V) line in most printers is shown as "VDD". The component designated "VCC-PH" can be used to apply an external voltage to the print head.

The table below details components that may be used to assemble DAU 20, as it is shown in FIG. 2.

| Schematic Label | Part # | DESCRIPTION | Manufacturer |
|---|---|---|---|
| U1 | C8051F321 | MICROCONTROLLER | SILICON LABORATORIES |
| CR1 | SMDA05 | TVS NETWORK S0-8 | MICROSEMI |
| D1,2 | B120 | SCHOTTKY DIODE SMA PACKAGE | DIODES INC. |
| R1 | ERJ-2RKF8252? | 82R5K OHM, 1/16 W, 1%, 0402 PACKAGE | PANASONIC |
| R2 | ERJ-2RKF7151? | 7R15K OHM, 1.16 W, 1%, 0402 PACKAGE | PANASONIC |
| R3-9 | ERJ-2GEJ101? | 100 OHM, 1/16 W, 5%, 0402 PACKAGE | PANASONIC |
| R10 | ERJ-2GEJ103? | 10K OHM, 1/16 W, 5%, 0402 PACKAGE | PANASONIC |
| C1 | ECS-T1AZ105? | 1 uF, 10 WVDC, TANTALUM CAPACITOR | PANASONIC |
| C2,3,5 | ECJ-0EB1A104K | 0.1 uF, 10 WVDC, CERAMIC CAPACITOR | PANASONIC |
| C4 | ECS-T1AZ475? | 4.7 uF, 10 WVDC, TANTALUM CAPACITOR | PANASONIC |
| CN1 | 787616-1 | USB CONNECTOR | AMP |
| CN2 | DF13-6P-1.25DS | 6 POSITION, 1.25 MM RT. ANGLE HEADER | HIROSE |

The DAU 20 preferably includes at least one memory 34 and multiple electrical components that are in communication with the microcontroller 46. The memory 34 may include any suitable type or combination of memories, such as FLASH, EEPROM, EPROM, RAM, or the like. Other electrical components shown in the illustrated circuit are: capacitors 48, polarized fixed capacitors 50, resistors 52, zener diodes 56, grounds 58, voltage regulator inputs 60, and diodes 62. The particular electrical components, as well as the illustrated circuit configuration, can be varied without departing from the scope of the present invention. Referring again to FIG. 1, the print head driver circuit 30 shown in block form receives a communication signal 28 to communicate the printing data to the print head from the on board driver circuit shown in exemplary detail in FIG. 3.

It is preferred that the DAU 20 be integrated with the print head to provide a "smart" print head, however, it may be interfaced with an external operating system 70. The operating system 70 can be a personal computer, a local server, or a remote server that is communicated with via a wireless interface or a physical network.

Within DAU 20, a usage tracking module 32 operates to determine an amount of linear printing performed by the print head. Data from the usage tracking module 32 allows analysis of the print head's probable operational life. The usage tracking module 32 provides information on the average print head longevity and allows refinements to more precisely determine activity issues so performance can be improved upon.

As will be described below, some of the characteristics of the print head which may be determined by the usage tracking module 32 include, but are not limited to: (1) pulse repetition analysis/characterization; (2) print speed analysis; (3) voltage analysis/characterization; (4) tracking open and shorted elements; (5) encrypted data transmission; (6) environmental data acquisition; and/or (7) operational data acquisition. It is preferred that the DAU 20 use an analog/digital converter to read the thermal head voltage (i.e., the voltage in which the print head is operating) and to read the thermistor signal 18 to determine the print head operating temperature.

Referring to again FIG. 3, the exemplary thermal print head driver circuit 30 the thermal print head includes a print surface capable of producing eight hundred thirty-two (832) ink dots. Each dot is created by ink separated from an ink reservoir in the print head due to heat generated by an associated resistor 52 or other heating element. Referring to the top of FIG. 3, locations associated with potential ink dots 54 are arranged in groups of 64 to simplify the schematic. The number of ink drops firing from the print head is determined, in part, by the data signal 28 which preferably is received as a multiplexed signal of multiple parallel data signals 28A-28D.

The data signals 28A-28D are processed by data latches 56 that are controlled by the latch signal 14 and the clock signal 12 from the DAU 20. The data latches 66 (also known as "flip flops") output signal to AND gates 68. The AND gates 68 also receives a strobe signal 16 from the DAU 20. The strobe signal 16 from the DAU 20 preferably includes multiple strobe signals 16A-16D. The AND gates process the output of the flip flops 66 and the strobe signals 16A-16D to provide a digital signal. The resultant digital signal is processed by an inverter 64 and then passed through a heating or resistive element 52. When current is passed through the heating or resistive element 52, an ink dot is ejected from an associated location of the ink reservoir of the print head.

It is preferred that the controller 46 has a dedicated interrupt that is edge sensitive per each active low transition of the print head latch signal, which is active once per each print line. The processing of the interrupt will include, but not be limited to, incrementing a printer line counter value that is stored in the print head sensor and control circuit's memory 34. It is preferred that the DAU 20 have a dedicated interrupt that occurs at predetermined intervals. During the interrupt, the DAU 20 samples data channels conveying information from the print head.

Referring again to FIG. 1, it is preferred that the DAU 20 includes a voltage tracking module 38. The voltage tracking module 38 preferably determines the operating voltage of the print head. The operating voltage of the print head can be measured by determining an average print head voltage, a maximum print head voltage, and/or a minimum print head voltage. The maximum voltage that the print head is operated at provides useful information as to whether the print head was used under proper operating conditions. If the average print head voltage, the minimum print head voltage, or the maximum print head voltage is outside of normal operating ranges, the corresponding print head data can be useful when evaluating a print head malfunction or performance quality.

A data transfer module 36 operates on the DAU 20 and is configured to send data to the external interface 24. It is preferred, but not necessary, that the external interface 24 is a USB interface. The external interface 24 is preferably interrupt driven and the data transfer module 36 is preferably capable of encrypting data communications that are sent to another operating system 70. The interface connector 22 is preferably a dedicated port for programming the microcontroller 46 directly. The interface connector 22 is used to initially program the DAU 20. The data transfer module 36 will preferably monitor for external requests for information from an external operating system 70. When the data transfer module 36 receives a request, it can reply by sending data stored in memory 34 through the external interface 24 to the external system 70. Preferably the data transfer module 36 requires a password prior to transmitting data.

It is preferred that the DAU 20 include a printer power module 40 that operates to determine an amount of power at which the printing system operates. The wattage at which a particular print head operates is critical to both print quality and the longevity of the print head.

It is preferred that the DAU 20 stored data include data on the date of manufacture of the print head and the serial number of the print head in the memory 34. Additionally, it is preferred that the information include operational and design specifications of the print head. Intended use and design specification data may include: (1) the product type/machine models with which the print head is compatible; (2) the print resolution (dots per inch) at which the print head is designed to typically function; (3) the resistance with which the print head is designed; (4) the wattage at which the print head is designed to operate; (5) information about the product warranty (preferably quantified in an amount of linear inches); and (6) a maximum operating pressure at which the print head is designed to function.

The print resolution information is important because the product function for the printing system 10 is preferably measured in an amount of linear printing at a specific print resolution. If a different print resolution is used, the product may fail prematurely or premature failure may signal the need that the head be modified accordingly to take into account conditions reflected in the monitoring by DAU 20.

The resistance at which the print head should operate is important because it is related directly to the voltage that the print head experiences when operating at a preset wattage.

Referring again to FIG. 1, it is preferred that the printing system 10 include a temperature sensor in communication with the DAU 20 for monitoring the operating temperature of the print head. A temperature tracking module 42 obtains data from the thermistor 44 and thermistor signal 18.

The present invention includes a method of monitoring print head performance. The method is preferably practiced using the printing system 10 and DAU 20 described above. The method of the present invention preferably includes evaluating data representing the amount of completed linear printing to determine a percentage of an expected operational life provided by the print head prior to malfunction. This percentage can be used along with other collected performance and operation data to diagnose the cause of failure of the print head.

The percentage can be used to provide analysis to determine a warranty credit toward a replacement print head or possible product improvements based on failure analysis. Examples of data that is useful for diagnostic purposes or that may be required for warranty evaluations may include, but are not limited to: (1) the specific machine model of the printer in which the print head is installed; (2) whether the print head is being used for direct thermal printing or thermal transfer printing; (3) identification of a label material manufacturer so that the label coatings exposed to the print head can be determined; (4) identification of a label material product code so that specific paper types and thicknesses can be determined; (5) identification of a type of adhesive used with a pressure sensitive label; (6) identification of a ribbon material manufacturer so that specific ribbon coatings can be identified; (7) identification of a ribbon product code so that ribbon characteristics can be identified; (8) data regarding whether the ribbon is a wax ribbon, a wax-resin ribbon, or a resin ribbon, since the type of ribbon affects the operating conditions and the expected operational life of the print head; (9) data regarding environmental conditions, such as dust, humidity, temperature, etc.; (10) data regarding pressure settings of the print engine; (11) identification of a print density setting so that whether the setting is suitable for a particular media can be determined; (13) data regarding frequency of cleaning of the print head; (14) data regarding method of cleaning by a user; (15) data regarding the date of installation of the print head by the user; (16) data regarding a date of removal of the print head so that volume of ink remaining can be estimated; and (17) data regarding a cause of failure, such as mechanical abrasive wear, operator inflicted scratches, thermal breakdown, or the like.

As detailed above, the method of the present invention preferably includes collecting data regarding the type of medium on which the print head is printing and collecting data regarding operational characteristics of the print head during printing. Examples of operational characteristics, such as voltage, speed, power, or the like, are described above. The recording and/or monitoring of this information provides diagnostic information that is not generally observable during a typical visual inspection. By monitoring characteristics, such as voltage, during print head operation, inappropriate operating conditions can be used to prevent print head failure and for product improvement.

The operational characteristic data is preferably correlated with the type of medium data to provide quantifiable data regarding the compatibility of the medium used with the print head. The method of the present invention provides quantifiable compatibility data useful to manufacturers of print heads and the media used with the print heads. Thus, the method of the present invention allows the establishment of bench marks for various combinations of print heads and printable media.

Analyzing the bench marks allows a print head manufacturer to design a superior product. The bench mark data also allows the print head manufacturer to focus on delivering the most value at the lowest cost by optimizing other parameters.

It is recognized by those skilled in the art that changes may be made to the above described embodiments of the invention without departing from the broad inventive concept thereof. For example, the print head may include only the print head driver head 30 or may include the print head driver circuit 30 and the print head sensor and control circuit 20 without departing from the scope of the present invention. It is understood, therefore, that this invention is not limited to the particular embodiments disclosed, but is intended to cover all modifications which are within the spirit and scope of the invention as defined by the appended claims and/or shown in the attached drawings.

What is claimed is:

1. A print head comprising:

memory to store usage data associated with the print head; and a controller to encrypt a communication including the usage data stored in the memory, wherein the encrypted communication is to be transmitted from the print head to a device.

2. A print head as defined in claim 1, wherein the controller requires a password prior to transmitting the usage data stored in the memory.

3. A print head as defined in claim 1, further comprising a print head driver circuit, wherein the usage data associated with the print head is obtained via the print head driver circuit.

4. A print head as defined in claim 1, wherein the device is an operating system in communication with the print head.

5. A print head as defined in claim 1, wherein the controller is to encrypt the communication in response to a request from the device.

6. A print head as defined in claim 1, wherein the usage data associated with the print head comprises information representative of an operation of the print head.

7. A print head as defined in claim 1, wherein the usage data associated with the print head comprises information representative of a characteristic of the print head.

8. A print head as defined in claim 1, further comprising an interface wherein the encrypted communication is to be transmitted from the print head to the device via the interface.

9. A method, comprising:

storing usage data associated with a print head in memory, wherein the memory is integral with the print head;

encrypting, via a controller of the print head, a communication including the usage data stored in the memory; and conveying the encrypted communication from the print head to a device.

10. A method as defined in claim 9, further comprising monitoring for an external request for the usage data stored in the memory.

11. A method as defined in claim 10, wherein the encrypting of the communication is performed in response to the external request.

12. A method as defined in claim 11, wherein the external request is received from the device.

13. A method as defined in claim 9, further comprising requiring a password prior to providing access to the usage data stored in the memory.

14. A method as defined in claim 9, wherein the usage data associated with the print head comprises information representative of an operation of the print head.

15. A method as defined in claim 9, wherein the usage data associated with the print head comprises information representative of a characteristic of the print head.

16. A method as defined in claim 9, wherein the device is an operating system in communication with the print head.

17. A microcontroller implemented on a print head having memory integral with the print head, the microcontroller comprising:

a logic circuit configured to:

monitor an interface for an external request for printhead usage data stored in the memory; and in response to receiving the external request, encrypt a data transmission including the printhead usage data stored in the memory prior to conveyance of the data transmission to a device.

18. A microcontroller as defined in claim 17, wherein the device is external to the print head.

* * * * *